US005861105A

United States Patent [19]

Martineau

[11] Patent Number: 5,861,105

[45] Date of Patent: Jan. 19, 1999

[54] CONCRETE FORM SYSTEM

[76] Inventor: Julien Martineau, 47 Heritage, Chelsea, Quebec, J0X 1N0, Canada

[21] Appl. No.: 769,534

[22] Filed: Dec. 19, 1996

[30] Foreign Application Priority Data

Jul. 25, 1996 [CA] Canada ..... 2182055

[51] Int. Cl.[6] ..... E04G 11/08; E04G 17/075

[52] U.S. Cl. ..... 249/44; 249/40; 249/83; 249/190; 249/219.2

[58] Field of Search ..... 249/40, 44, 45, 249/83, 219.2, 190

[56] References Cited

U.S. PATENT DOCUMENTS

| | | | |
|---|---|---|---|
| 2,413,415 | 12/1946 | Olson . | |
| 2,613,424 | 10/1952 | Kenney . | |
| 2,952,060 | 9/1960 | Allen | 249/41 |
| 3,067,479 | 12/1962 | Schimmel . | |
| 3,450,380 | 6/1969 | Fontaine | 249/45 |
| 3,746,297 | 7/1973 | Daniels . | |
| 3,995,825 | 12/1976 | Ward . | |
| 4,125,245 | 11/1978 | Seidl . | |
| 4,234,156 | 11/1980 | Wepf . | |
| 4,426,061 | 1/1984 | Taggart | 249/45 |
| 4,791,767 | 12/1988 | Boeshart . | |
| 4,889,310 | 12/1989 | Boeshart | 249/41 |
| 5,140,794 | 8/1992 | Miller . | |
| 5,465,542 | 11/1995 | Terry . | |
| 5,488,806 | 2/1996 | Melnick . | |
| 5,651,910 | 7/1997 | Myers et al. | 249/45 |

*Primary Examiner*—James P. Mackey
*Attorney, Agent, or Firm*—George E. Fisk

[57] ABSTRACT

A concrete form system is disclosed, together with a method of assembling it and particular ties useful with it. The system has a concrete form with two opposed walls and a cavity between to be filled with concrete. One wall is made of conventional wood or metal panels. The other wall is made of foam panels. Vertical joins between plywood or metal panels are directly opposite vertical joins between foam panels. The system provides ties to join the two walls and brackets or retaining members to spread the forces on the ties so they do not pull out of the foam wall.

4 Claims, 12 Drawing Sheets

40
44
42
43
41

50
44

46
46
46
X
42
41

41
42
46

Fig. 6A
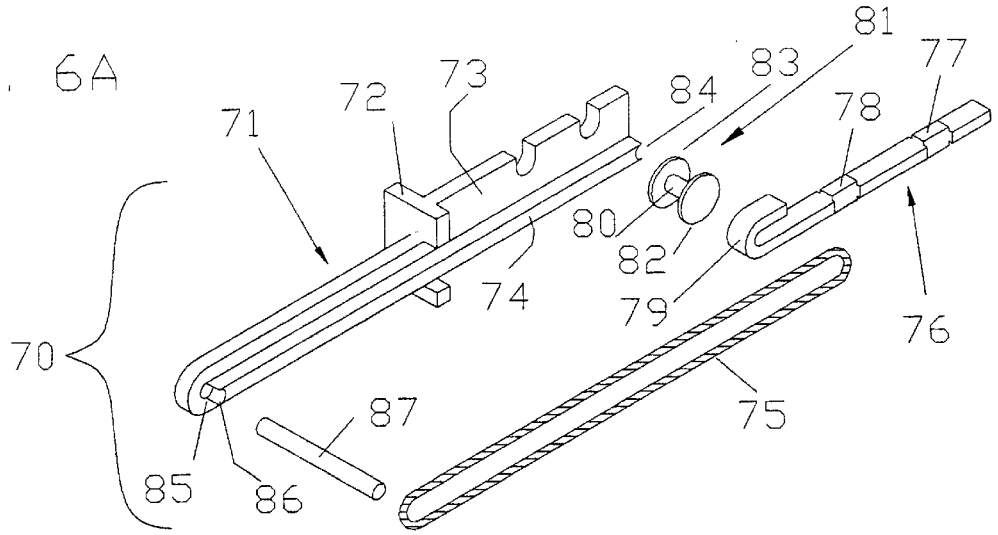
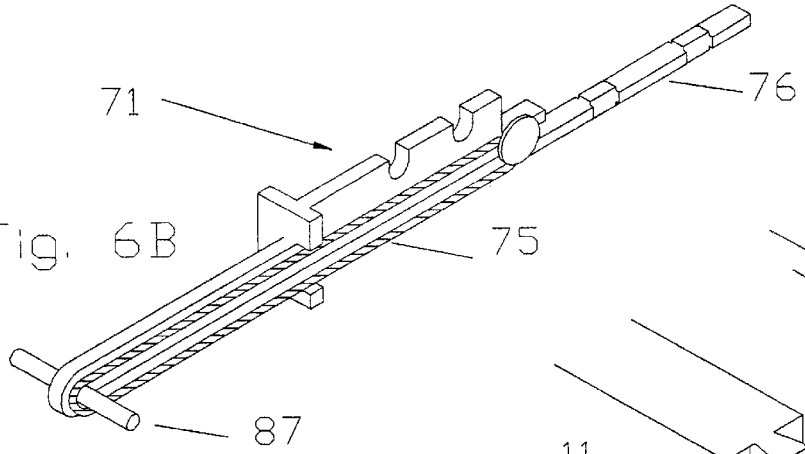
Fig. 6B
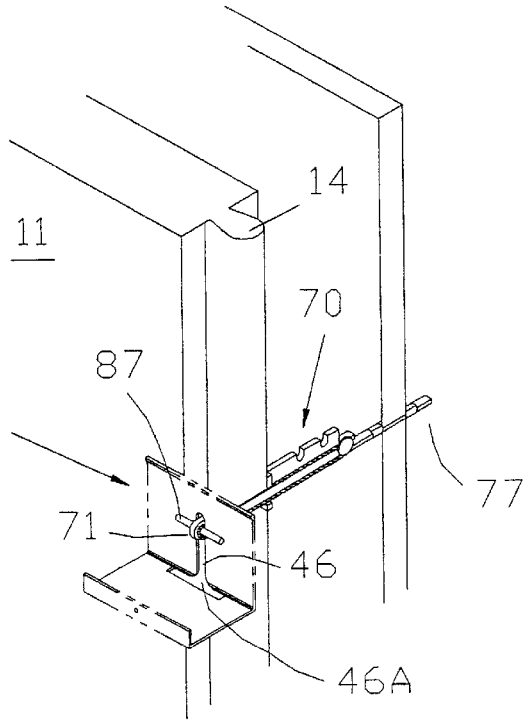
Fig. 6C 376
378
379
380
377
350
305
375
11
14
352
358
350
354
308
305
350
317
306
303B
315
352
316
301B
351
302
301A
300
303A
X
350
W
Y
303B
Z
354
391
350
392
303
390

CONCRETE FORM SYSTEM

FIELD OF THE INVENTION

This invention relates to forms for the pouring of concrete, to ties for spacing such forms from one another, and to brackets useable with such ties and forms for placing reinforcing walers to reinforce such forms. It also relates to a method for forming concrete walls using the forms and ties of the invention.

BACKGROUND OF THE INVENTION

In the pouring of concrete walls, such as for example foundation walls, what is typically done is to pour concrete footings on a suitable bed of gravel or the like. These footings extend upward to the level where the floor of the basement (or first storey, if there is no basement) will be. Two opposed forms are then erected which define between them a cavity into which concrete is poured. The forms are typically of metal or wood, and are of a standard size. Typically, the forms forming opposite faces of the cavity are joined together with pins (sometimes known as "ties") of metal or plastic. The ties are left in the concrete after it is poured, and form part of the wall.

Forms are typically supplied as a "system", which is a series of mating forms, often including forms of different sizes which are designed to be used with one another. There are a many systems in common use. They exhibit many different ways of joining the forms together edge to edge.

One of the most widely used systems of forms is composed of reusable plywood sheets of standard sizes, which are reinforced by having horizontal bands of metal reinforcement spaced at standard intervals and extending across their width on the face not intended to contact the concrete. For example, standard sheets of plywood for use in the system may be 8 feet in height, and 2 feet wide and of 1¼" thickness. The bands of metal are iron bands of about 3" inches in width and of the order of ⅛" to ¼" thick. They extend parallel to the 2 foot dimension of the sheet at arbitrary distances from each other and the 2 foot long edges of the board, and extend the full width of the board, from one of the edges of a long side to the other edge of a long side. For example, commonly there are four bands, having their mid-lines at 8", 28", 52" and 76" respectively from the 2 foot edge which forms the bottom edge of the plywood sheet when it is assembled into a form, Mounted on one end of each band, for example near the right edge of the face, is a pivotable hooking element, which pivots over and is retained by a post such as a large headed nail or screw or the like near the left edge of an adjacent like panel. Similar hook and post arrangements occur on the other bands, to hook adjacent panels together to make a form. The hooking element also has at least one (usually two) slots to fit over and retain in place iron ties extending to the similar forms making up the opposite wall of the cavity into which concrete is to be poured.

It is also known to build forms of blocks of plastic foam which define the cavity into which the concrete is poured. The foam is usually foamed polystyrene, although other types of foam plastic are sometimes used. The plastic foam can be left in place after the concrete is poured to function as insulation. Many form systems using foamed plastic are known. Representative ones are shown in U.S. Pat. No. 4,889,310 (Boeshart) and U.S. Pat. No. 5,140,794 (Miller). In the Miller patent, the forms are joined together by ties of wire. In the Boeshart patent, the ties are plastic.

Many systems use strengthening members, which are sometimes known as walers or wales, on the sides of the forms which do not contact the concrete. These may be horizontal or vertical, or both. Often, such walers are pieces of standard sized lumber, such as two-by-fours (lumber which is nominally 2" by 4" in cross section, although it is smaller after being dressed.) The forms or ties can be provided with members sized to hold walers of lumber. After the concrete has set, the walers are removed and the members which held them are removed in some way. In the Boeshart patent discussed above, the walers are held by an extension of the plastic tie, and the extension is removed by breaking it off. In U.S. Pat. No. 2,952,060 (Allen), the walers are held by brackets which attach to projections extending from the faces of plywood forms.

Most forming systems use either foamed plastic or plywood, but not both, to make their forms. U.S. Pat. No. 4,426,061, however, does show one embodiment where the forms on one side of the concrete cavity are of plywood and those on the other side are of foam. The patent is directed to a system which has tie members which interact with metal caps on the side edges of the foam panels. It also has metal channels in which the tie members rest. The system is a complicated one, with many parts which would be expensive to manufacture and keep in inventory. Additionally, the metal caps and metal channels provide passages for heat to travel around the foam panels, thereby greatly reducing the insulating effect of the foam panels.

Many contractors have a large investment in plywood forming panels. Such panels are reusable, and therefore tend to be cheaper than plastic foam panels, which stay in place and cannot be reused. However, the plastic panels do provide insulation value for the structure being built. There is therefore a need for a foam panel and tie system which is compatible with existing plywood systems, so that plywood can be used for forming which will be outside the building to be constructed and foam can be used for the forming to be inside the building to be constructed. Such a system should also be simple, with few parts to be kept in inventory.

THE INVENTION

The invention is designed to be used with standard wood or metal forming systems, where the ties are joined to the forms along the intersecting edges of two adjacent forms. In particular, it is designed to be used with the system described above where there are metal bands and hook members mounted on plywood forms. However, the invention can also be used with other known systems of wood and metal forms. The inventive forms can also be used alone without plywood or metal forms if they are suitably supported and braced, but this is not preferred, as the plywood or metal offers rigidity and support to the foamed plastic panels of the forms of the invention. The ties, and their means of attachment to the plywood or metal panels and to the foam panels, function to transfer the outward pressure of the wet concrete to the metal or plywood panels from the foam panels, thus reducing the likelihood that the foam panels will buckle under the pressure.

In the preferred embodiment, the invention provides slabs of foamed polystyrene or other foamed plastic which are dimensioned the same as the individual units of the metal or wood forming system with which they are to be used. For example, if the system is to be used with the iron-banded plywood forms described above, the foamed plastic panels will be 2 feet by 8 feet, the same height and width as the standard panels of the iron-banded system. It will also have corner pieces for 90° corners and possibly 45° and 30° corners as well, and short lengths which correspond in length and height to the corresponding members in the iron-banded plywood system. The thickness of the foam panels will of course be greater than that of the plywood panels, so that the insulation benefits of the foam can be realized. The corner foam pieces can desirably differ from the lengths of corresponding plywood corner pieces by an amount which compensates for the extra thickness of the foam. If the invention is used with some other conventional plywood system, the heights and widths of the foam panels will be designed with regard to the heights and widths of the plywood panels of that system, so as to be useable with it.

Suitably, the long-edges of the foamed plastic forms, which will abut in use, are made to interlock, by having, for example, mating tongue and groove arrangements.

Ties, which preferably do not provide a thermal conductor through the foam, are provided. On one end, the ties are formed to connect with the securing means provided in a prior art plywood forming system, For example, they can be formed to enter into and be retained by the slots in the iron-banded prior art system discussed above. The other end of the ties is a retainer end, with retaining means such as an enlarged head or crosspiece, which permits a bracket or retaining plate to be secured on the tie. The bracket or retaining plate holds the foamed plastic forms of the invention in place. If a bracket is used, rather than a retaining plate, it can support horizontal walers for further strengthening of the form. The retaining plate can if desired extend horizontally to engage the heads of several ties, and will therefore itself have a strengthening function like that of a waler.

Once the concrete has set, the retaining plate or bracket can be removed and a stud or other material into which wallboard screws can be driven can be secured on the the ties to facilitate the mounting of wallboard. Alternately, the retaining plate itself can be of a material which retains screws well, and it can be left in place rather than being removed.

The invention thus provides a form having plywood one side of the concrete wall to be poured and having foam insulation on the other side. After pouring and setting of the concrete, the plywood forms are removed for renewal, while the foam panels stay in place as insulation. Usually, the forms are assembled so that the foam insulation will be on the side of the concrete wall which becomes the inside of the building. However, it is also possible to assemble the form so that the insulation is on the side which becomes the exterior of the building, where external insulation is desired.

DESCRIPTION OF THE DRAWINGS

FIG. 1A shows a perspective view of a typical iron banded plywood forming system with which the present invention is compatible. FIG. 1B is a detail of FIG. 1A, showing the hooking device. FIG. 1C is a detail of FIG. 1A, showing the tie member.

FIG. 4A shows a bracket which engages a single tie. FIG. 4B shows a retaining plate. FIG. 4C shows an angle-iron type bracket which engages several ties. FIG. 4D shows an alternate embodiment of an angle-iron type bracket.

FIG. 6A and FIG. 6B are perspective drawings showing respectively a disassembled and an assembled tie useable in another embodiment of the invention. FIG. 6C is a perspective drawing of a tie according to FIG. 6B in place joining a plastic foam panel and a plywood panel.

FIG. 7C is partially cutaway.

FIG. 8A is shows a foam panel for use with this embodiment, and the reinforcing and tie pieces for use with it. FIG. 8B shows, on a larger scale, two of the pieces shown in FIG. 8A. FIG. 8C shows the reinforcing and tie pieces in their assembled form, and a bracket and walers useable with the embodiment. FIG. 8D. illustrates the waler assembly.

DETAILED DESCRIPTION OF THE INVENTION

Figure 1A:
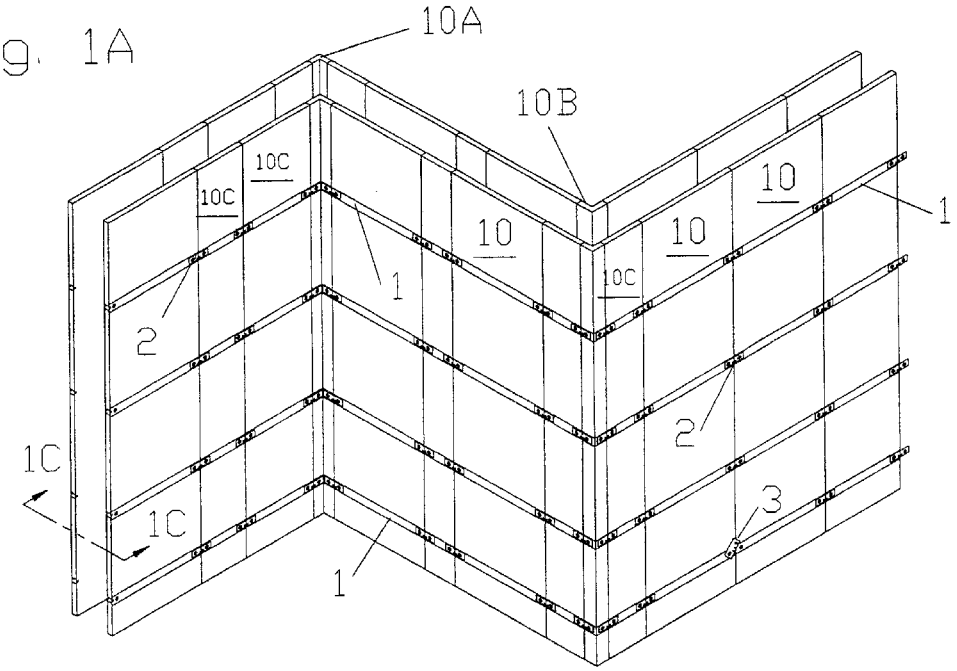
PRIOR ART Fig. 1A
FIGS. 1A, 1B and 1C show a Prior Art system.
Figure 1B:
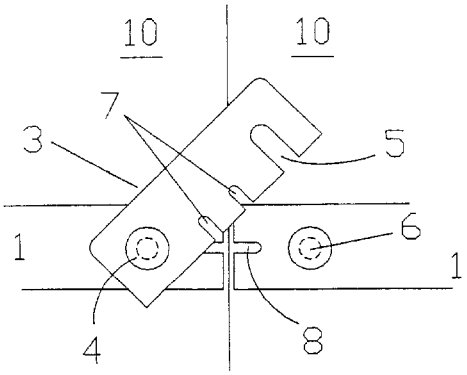
Figure 1C:
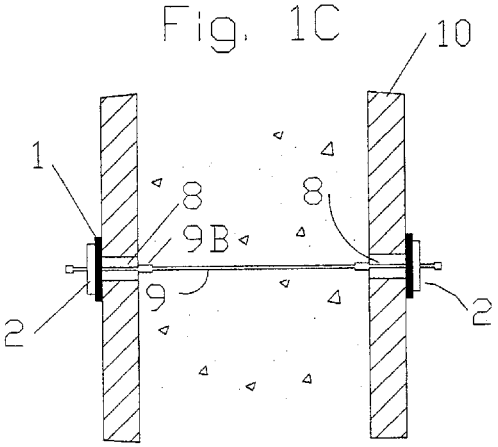
Figure 1D:
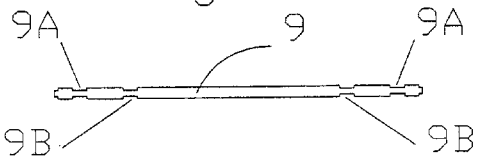
FIG. 1D shows the tie member alone.

To understand the invention fully, it is necessary to describe a typical prior art plywood forming system as shown in FIGS. 1A, 1B and 1C. Such a system has conventional panels 10 of wood or metal. Typically, they are plywood, and will be described as plywood during the remainder of this disclosure. Usually, it also has specially sized and shaped panels shape such as corner pieces 10A and 10B and short straight pieces 10C.

Each panel has a series of parallel metal strengthening bands 1 running from edge to edge in a direction which is horizontal during the the use of the forms. The system illustrated has four bands, but other systems may have other numbers of bands.

On bands 1 are hooking members 2. Most are shown hooked, but one, shown as 3 in FIG. 1A and shown in detail in FIG. 1B, is unhooked for illustration. Hooking member 3 is permanently attached to a band 1 on a panel 10 (in FIG. 1B, the panel 10 to the left of hooking member 3) by being pivotally secured for rotation about a large-headed pin 4. Hooking member 3 has a slot 5 which is sized to fit over the shaft of a large headed pin 6 on the band 1 of an adjacent panel 10. There are two smaller slots 7 in hooking member 3 which, when the hooking member is in closed position, lie over notches 8 in bands 1 and their associated panels 10.

FIG. 1C shows a cross-section through a form, showing two hooking members 2 in closed position and a tie 9. Tie 9 is secured in one of the notches 8 by having a narrowed portion 9A of its shaft pass through one of the slots 7 in each hooking member 2. It is retained in place because the narrowed portion 9A is just large enough to pass into slot 7. The normal cross-section of tie 9 (which can be of any suitable cross section, such as round, rectangular or square) is too large to pass through slot 7. Thus, the tie is locked in position. The other end of tie 9 has a similar narrowed portion 9A, which locks it into position with respect to the form on the other side of the wall.

Ties 9 are made of metal, and remain in the wall after it is poured. They are provided with weakened portions 9B, which can be severed using a suitable tool after the plywood forms are removed, so that ties 9 will not then protrude from the concrete wall.

Figure 2:
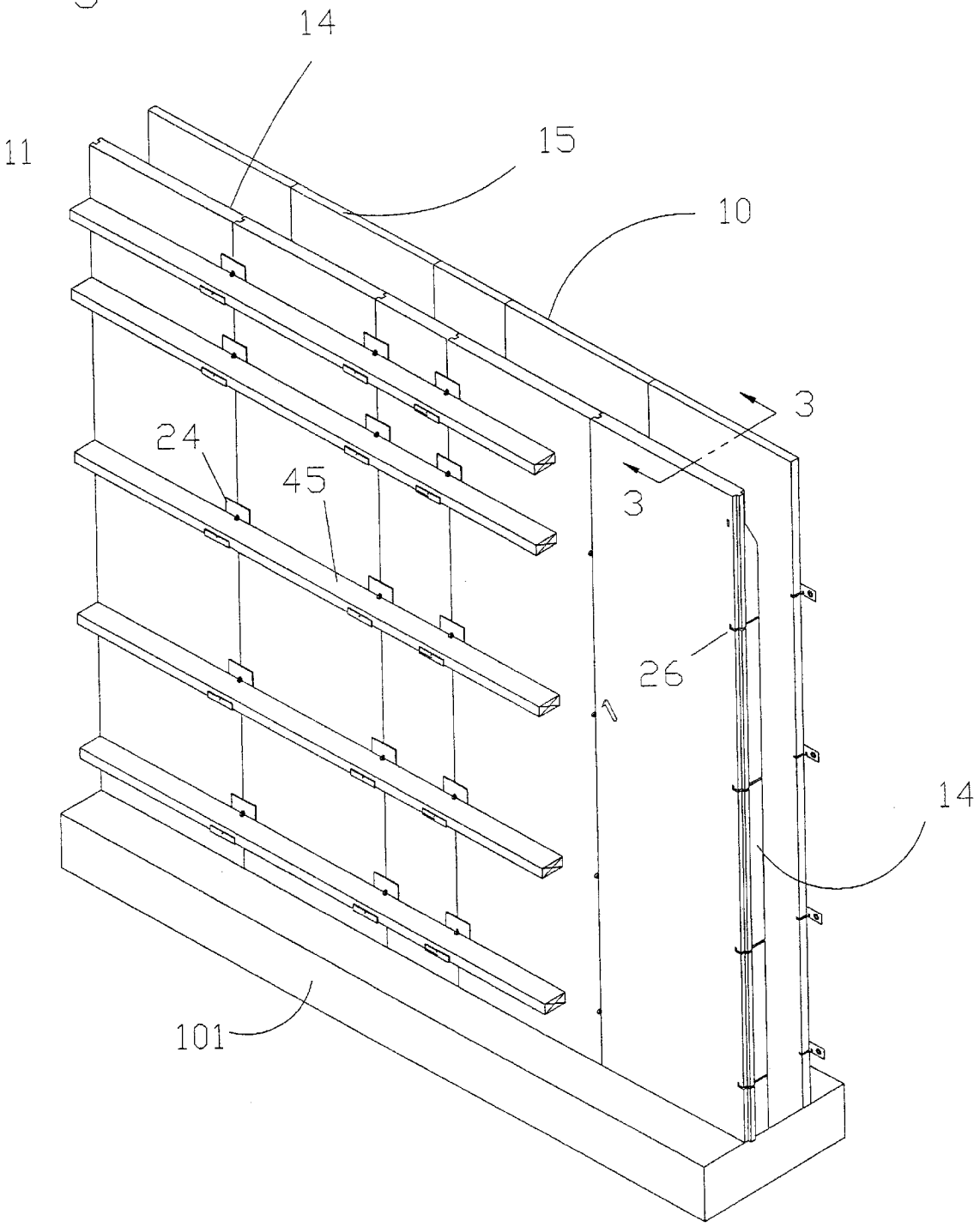
FIG. 2 shows a perspective view of a form with one wall of the form made of foamed plastic of the inventive system and one of plywood.

The panels of the invention are shown at 11 in FIG. 2. They are elongated slabs of foamed polystyrene or other foamed plastic. They are preferably equipped on their side edges with an interlock so that they join tightly. An interlock with tongue 14 and mating groove 15 running the length of the sides of the panels is suitable. The tongue and groove can be of mating right angled configuration, as shown in FIG. 2, or the tongue can be of as slightly bulbous cross section, as shown at 14A in FIG. 5C, with the groove shaped to match. Because the foam has some flexibility, the tongue 14A can be popped into the grove and will be retained there. Generally, the tongue and groove of right angled shape (FIG. 2) is preferred, for ease of molding and of assembly.

As shown in FIG. 2, the foam forms are assembled so that each is opposite a plywood panel so that the vertical edges of the foam panel align with the vertical edges of the plywood panel. Usually, this means that the foam and plywood panels are alike in height and width, but this is not necessarily the case. For example, there may be two short plywood panels, the aggregate width of which adds up to the width of the foam panel, opposite s single foam panel. Also, where the wall to be poured has corners, an inside corner form of either plastic or plywood will be opposite an outside corner form of the other material (See FIG. 9).

Figure 3:
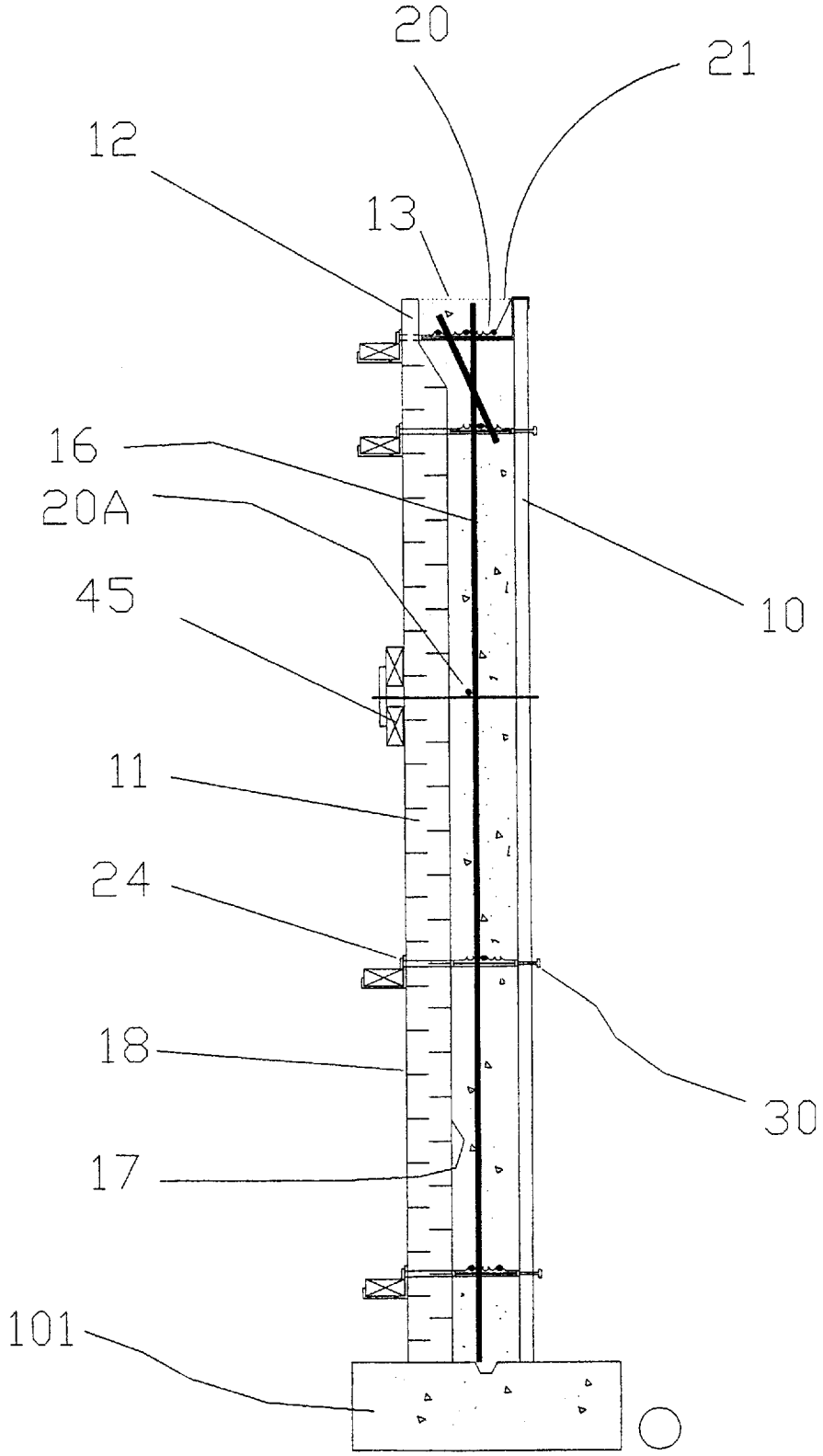
FIG. 3 is a cross-section through FIG. 2.

As shown in FIG. 3, the panels 11 preferably have a narrowed portion adjacent their tops, as shown at 12. The reason for this is so that the concrete which is poured between the slab 11 and the conventional retaining wall 10 will then come out with a wider surface (shown in dotted form at 13) at its top. It is convenient to have a wider surface 13 at the top of a concrete wall in many situations, for example to form a shelf-like area where a brick wall or the like can be laid. The tongue and groove 14, 15 provided at the ends of panels 11 are preferably centered to the narrowed portion 12, so that they extend to the top of the panels. In consequence, the tongue and groove are not centered on the ends of the panels 11 below the portion 12, but are instead nearer the the surface 18 of the panels which is not in contact with the concrete than they are to the surface 17 which does contact the concrete.

The surface 17 of panel 11 which contacts the concrete 16 is preferably smooth, so that voids will not form. The surface 18 which does not contact the concrete can be ridged if desired for strength.

Suitable reinforcing rods 16 (which do not form part of the invention) can be put into the cavity which is to hold the concrete, to act as concrete reinforcements. Panels 10 and 11 are preferably assembled on a pre-poured concrete footing 101, as is conventional for the assembly of known forms. Alternately, they can be assembled as a second course on top of another set of panels 10 and 11, where a wall is desired which is higher than the height of single panels 10 or 11.

Figure 5A:
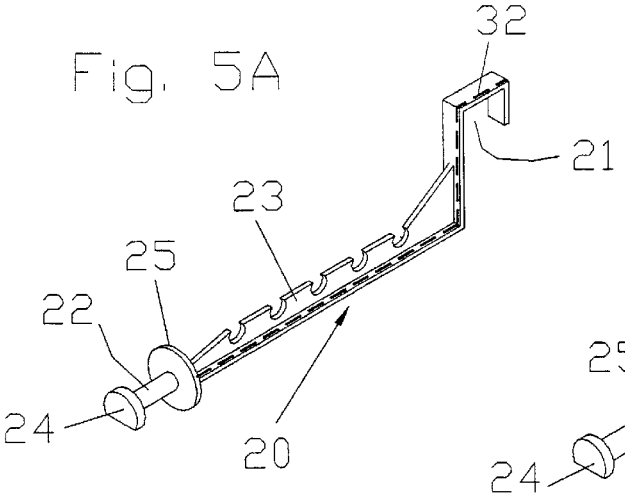
FIG. 5A and FIG. 5B are perspective drawings of two forms of tie useable in one embodiment of the invention.

FIG. 3, and FIGS. 5A, 5B and 5C illustrate ties according to one embodiment of the invention. According to this embodiment, the tie which is to be used at the top of the form is different from those used lower down. The top tie is indicated as 20, and is illustrated in FIG. 5A. It has a hooked portion at 21 which fits over the top of conventional plywood form 10. The other end has a projection 25 followed by a shaft 22 terminating in an enlarged head 24. The projection is shown as annular, but can be of other shapes if desired. The length of shaft 22 corresponds to the thickness of the slab 11, and projection 25 is placed to bear against the inner side of the slab. The head 24 preferably semi-circular for a reason to be explained below, but can be of other shapes. The portion of the tie between portion 21 and 25 has an irregular surface 23, which is intended to give it a good bond to the concrete to be poured in.

The other ties 20A (shown in FIG. 5B) are essentially the same as the top tie 20, except for the end which contacts the conventional plywood forms 10. In ties 20A, this end is sized to fit into the notches 8 in the conventional forms, and to be held by the slots 7 of hooking members 2.

Figure 5B:
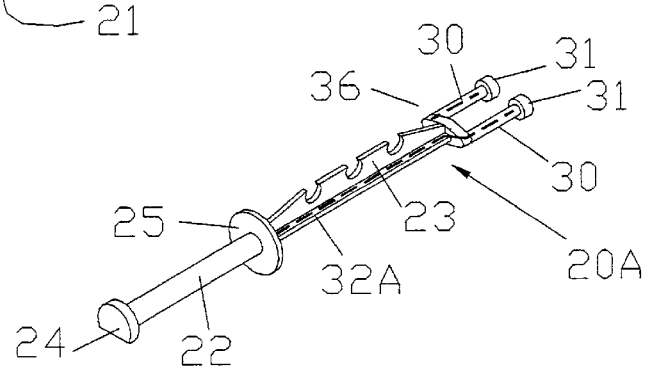

In the example shown in FIG. 5B, the tie piece, which is generally numbered 20A, has a bifurcated end to form two shafts 30 where it is to engage the retaining wall 20. Each of the shafts 30 terminates in an enlarged head 31. Shafts 30 are sized to pass through notches 8 and slots 7. The thickened heads 31 cannot pass through slots 7, so the ties remain in place against the plywood panels 10 when they are assembled.

One other difference between ties 20 and 20A is the length of the shaft 22. In the embodiment of FIG. 3, the panel 11 is thinner at the top than it is lower down, to permit the pouring of a concrete shelf area 13. Thus, shaft 22 is longer in ties 20A than in tie 20, as there is a thicker portion of the panel for it to pass through.

In this embodiment, the ties are preferably made of plastic. If desired, there can be a strengthening insert of a stronger material, such as KEVLAR™ polyaramid plastic, or SPECTRA™ high breaking strength plastic cord to prevent breakage, as shown in dashed form in FIG. 5A at 32 and in FIG. 5B at 32A respectively. Optionally, there may be a weakened portion 36 (see FIG. 5B) in the shafts 30 at the point where they would pass in use from the volume in which the wall is to be poured into the plywood. This facilitates breaking off the ends of the ties with a suitable tool after the concrete hardens and the plywood form is removed, so that the ties will not protrude from the new concrete wall.

The ties 20 and 20A are pierced through the polystyrene slabs 11 where two slabs join. Projections 25 bear against the slabs to prevent them from falling into the cavity where concrete is to be poured. It is relatively easy to make half a hole in each of the two adjacent slabs 11 by indenting them with portion 22 of the tie, so that it, in finished form, extension 22 passes through the hole thus formed where the slabs join, and projection 25 bears against the side of the slab around that hole. However, if desired, half holes can be moulded into the mating edges of the plastic foam slabs 11 as shown at 26 in FIG. 2 at heights corresponding to the heights of the hooking members 2 on the plywood sheets of the system with which the foam panels are to be used. The moulding of half holes 26 is not preferred, as it increases the complexity of the mould, and it is usually a simple matter to merely make half holes as necessary by pushing the tie against the edges of the foam panels.

To reduce the complexity of the molds for the pieces 20 and 20A, head 24 and annular projection 25 can be molded as separate pieces, and glued in place. If this is done, head 24 is provided with a recess (not shown) into which shaft 22 fits, and projection 25 has a slot which permits it to slide onto a narrowed mating portion of shaft 22.

Bracket 40 (See FIG. 4A) has a keyhole opening 44. Once the tie has been installed, this keyhole opening 44 slips over the shaft 22 of the tie, to hold bracket 40 in position. The half circular shape of the head 24 is preferred so that it can pass through hole 44 when the bracket 40 is held sideways, but cannot pass through when it is held in its normal installed position. If desired, a small sharp tab can be provided on the bracket to dig into the foam of slab 11 to resist rotation of the bracket. The resistance can of course be overcome by manual force.

One important function of bracket 40 is to spread the forces pulling on the tie over a larger area of the panels 11, so that the tie is not pushed through the panels. When wet concrete is poured into the cavity, it tends to spread to panels 11 farther apart from the panels 10. The tie counteracts this, by keeping the panels at a fixed distance. However, the foam in panel 11 is fairly weak, and head 24 could easily be pulled through the hole 26, which would enlarge to let it pass, if there were not something to retain it. When head 24 is securely lodged in keyhole 44, forces pulling the head 34 into hole 26 are spread over the whole face of bracket 40 which is in contact with the two panels 11. This helps to keep the tie in place, even under the spreading force caused by the wet cement.

Bracket 40 is usually made of iron for strength, but can be made of wood or plastic where the forces tending to pull head 24 through hole 44 are not too large. Such forces are caused by wet concrete in the cavity defined by the forms pushing outward against slab 11, and depend upon the weight per cubic foot and water content of the concrete column and the height of such column above the tie in question.

Bracket 40 is dimensioned so that a standard piece of 2"×4" lumber can rest on its bottom 41. An upstanding lip 42 prevents the lumber from falling out and, if desired, there can be a hole 43 in which to drive a nail to keep the lumber in position. A piece of lumber 45 is shown in a bracket 40 in FIGS. 2 and 3. It will be understood that the lumber runs horizontally from one bracket 40 to one or several horizontally spaced other brackets 40.

When bracket 40 is in position, it pushes the foam panel against annular projection 25, thus preventing the foam panel from falling into the cavity to be filled by concrete.

The purpose of the lumber 45 is to extend along the outside of the wall formed of foam pieces 11, to provide a waler or horizontal reinforcement against buckling of the wall. Reinforcement against vertical buckling is provided by the ties 20 and 20A, which essentially transfer forces from the weak polystyrene wall to the more robust metal or wood wall.

If it is not desired to use lumber walers, retaining plates 50 (FIG.4B) can be used instead. These function to retain the tie in place, but do not support walers. Retaining plates 50 are essentially the same as brackets 40, but do not have bottom 41 or lip 42.

Figures 4A, 4B, 4C, 4D:
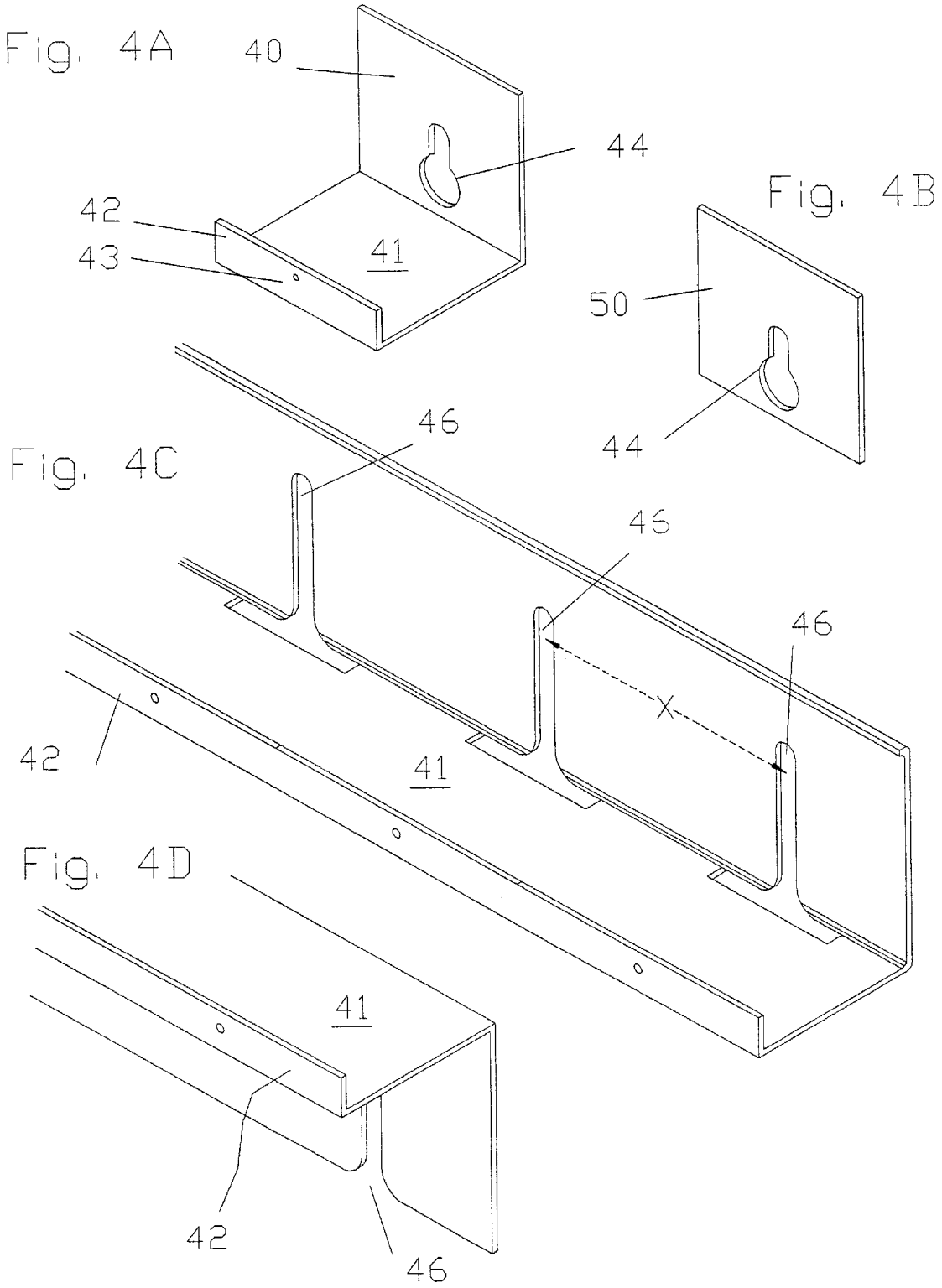
FIG. 4A, 4B, 4C and 4D illustrate alternative devices for retaining the foam panels in place by connecting them to the ties.

Other types of brackets or retaining plates can also be used, as shown in FIG. 4C and FIG. 4D. FIG. 4C illustrates a bracket with three slots 46, each of which can slip over a shaft 22 to retain the bracket, Slots 46 are spaced from one another a distance "x" which is the same as the width of a standard panel 11. This bracket can be used with a waler if desired, but it also provides horizontal strengthening itself. Another form of bracket is shown in FIG. 4D, where the bracket is formed with the shelf above the slot rather than below it. When the concrete has set, the plywood panels 10 which have formed one face of the foam are removed for reuse. The foamed polystyrene members 11 remain in place and form inside insulation for the building. The pieces of lumber 44 are of course removed, as are the brackets 40 which hold the lumber in place while the concrete is hardening.

It is generally desired to put wallboard in place over the foam panels. The heads 24 of the ties 20, 20A can be used after removal of the brackets or angle irons to support a holder for a substrate (such as for example a board) to which wallboard can easily be attached. The holder can be of the same form as bracket 40, but it can be made of plastic instead of metal to save cost and the bottom 41 can be sized if desired for a smaller piece of wood such as a 1" by 3" stud. Such a bracket is shown (in use with a different type of tie member) at 92 in FIG. 7E. Alternately, if retaining plates 50 are made of a material which is easily pierced by wallboard screws (such as some plastics), they can be left in place to provide a substrate to retain screws when wallboard is attached to the foam.

An alternate form of tie is shown at 70 in FIG. 6. This tie is designed to have considerable tensile strength. It can be used to replace all ties 20 and 20A in a particular installation, or it can replace only those ties where extreme tensile strength is required, as for example to counteract the outward spreading force generated near the bottom of a high form by reason of the weight of the wet concrete within the form.

Figure 8A:
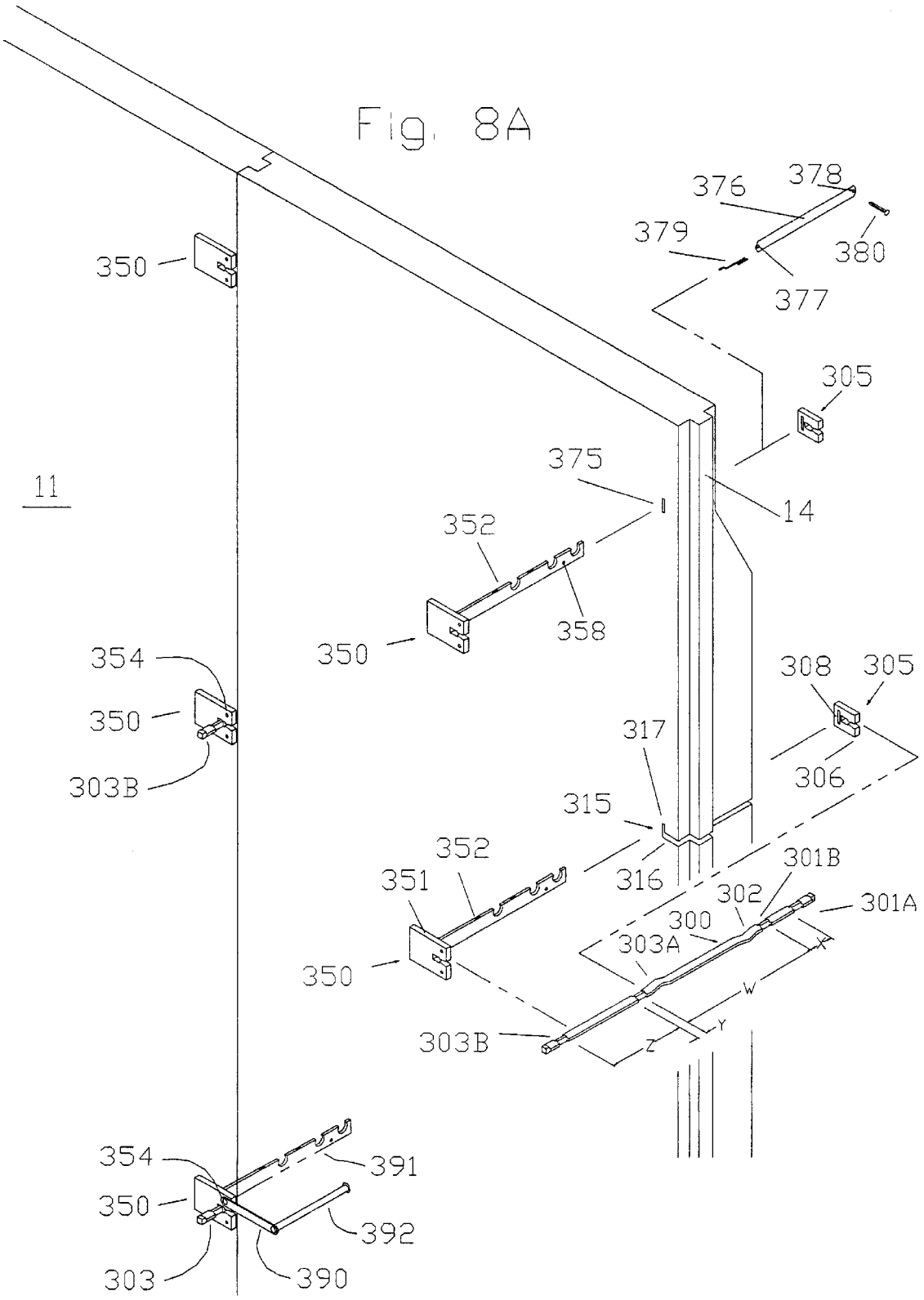
FIGS. 8A, 8B, 8C and 8D are all perspective drawings illustrating a further embodiment of the invention.

Tie 70 is shown in exploded perspective in FIG. 8A, and in assembled form in FIG. 6B. It has a moulded plastic piece 71, which can be of any reasonably strong mouldable plastic, such as PVC or high density polyethylene. Piece 71 has a rib 73 which extends substantially the width of the concrete wall to be poured, It terminates in a transverse wall 72, the function of which is to abut against the panels of foamed plastic and to keep them from falling into the cavity where the wall is to be poured. Thus, wall 72 has the same function as annular extension 25 in the embodiment of FIGS. 5A and 5B. Rib 73 is a strengthening member.

A transverse rib 74 also is moulded on member 71. This also has a strengthening function, but its main purpose is to provide a track for cable reinforcement 75. Cable reinforcement 75 is an endless loop of high tensile strength cable. Although a metal cable could be used, it is preferred to use a plastic cable which has a tensile strength great enough to withstand the expected tensile forces. A plastic cable conducts less heat than a metal cable. As the cord reinforcement, when installed, passes through the full thickness of the foam panels, it is not desired to have a cable which would conduct significant amounts of heat, thereby defeating some of the insulation value of having foam panels. Suitable cables, for example, are those woven from SPECTRA™ high strength plastic and having a diameter of ⅛" to ⅜".

Member 76 is provided to join to the plywood 10 of the existing plywood system. Member 76 is of metal and has a narrowed portion 77 which corresponds to narrowed portion 9A of tie 9 (FIG. 1) and a weakened portion 78 which corresponds to weakened portion 9B (FIG. 1)

Member 76 has a hook 79 at the end remote from narrowed portion 77. This hook fits over the shank 80 of a pin 81 with two enlarged heads 82, 83. Pin 81 with member 76 hooked to it, is assembled into a groove 84 at one end of member 71. Cable 75 is then passed around shank 80 and laid to run along both sides of rib 74. At the other end of member 71, rib 74 terminates in a groove 86 which continues as a hole 85 through member 71. To complete the assembly, a pin 87 is passed through the loop of cord 75 and is forced along groove 86 into hole 85. Cable 75 is just long enough so that it must be stretched to do this. Because of its woven construction, it retracts to its unstretched length after it is in position with pin 87 in hole 85. Thus, cable 75 holds shaft 80 and hence member 76 (at one end of member 71) and also pin 87 (at the other end) firmly in position.

Figure 5C:
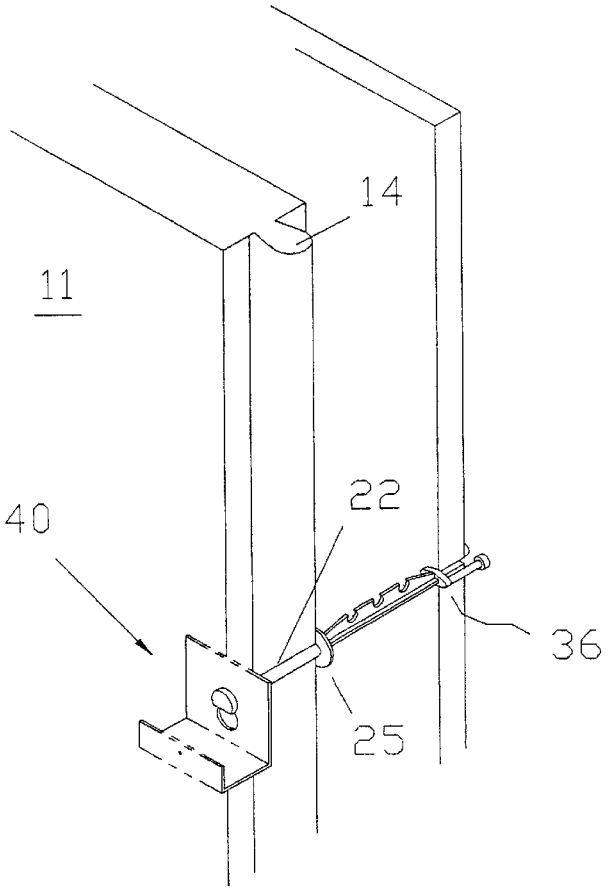
FIG. 5C is a perspective drawing of a tie according to FIG. 5B in place joining a plastic foam panel and a plywood panel, awaiting the attachment of the next adjacent plastic and plywood panels. For illustrative purposes, this also shows a bracket assembled to the tie.

The use of tie 70 is shown in FIG. 6C, and is similar to that of member 20A in FIG. 5C. In the case of tie 70, however, the end which engages the plywood is similar to a conventional tie 9, and functions in the same way. The end which extends through the foam does not terminate in an enlarged head such as head 24, but instead in pin 87. For use with pin 87, it is preferred to have a bracket with a slightly modified form of the slot 46 shown on the brackets in FIGS. 4C and 4D, to facilitate the attachment. Such a bracket is shown at 91 in FIG. 6C. There is a slot 46, but this is joined at its bottom by a transverse slot 46A. The pin 87 passes through transverse slot 46A, while the piece 71 protrudes through slot 46.

The brackets of FIGS. 4A and 4B can easily be modified for use with ties 70 by replacing keyhole 44 with slot 46 and slot 46A, or by having keyhole 44 of such size that pin 87 can pass through. It is preferable that there be a tab provided to dig into the foam panel to resist rotation of the bracket or retaining plate about shaft 22, to prevent the tie from falling out of the slot or keyhole.

Figures 7A, 7B, 7C, 7D, 7E:
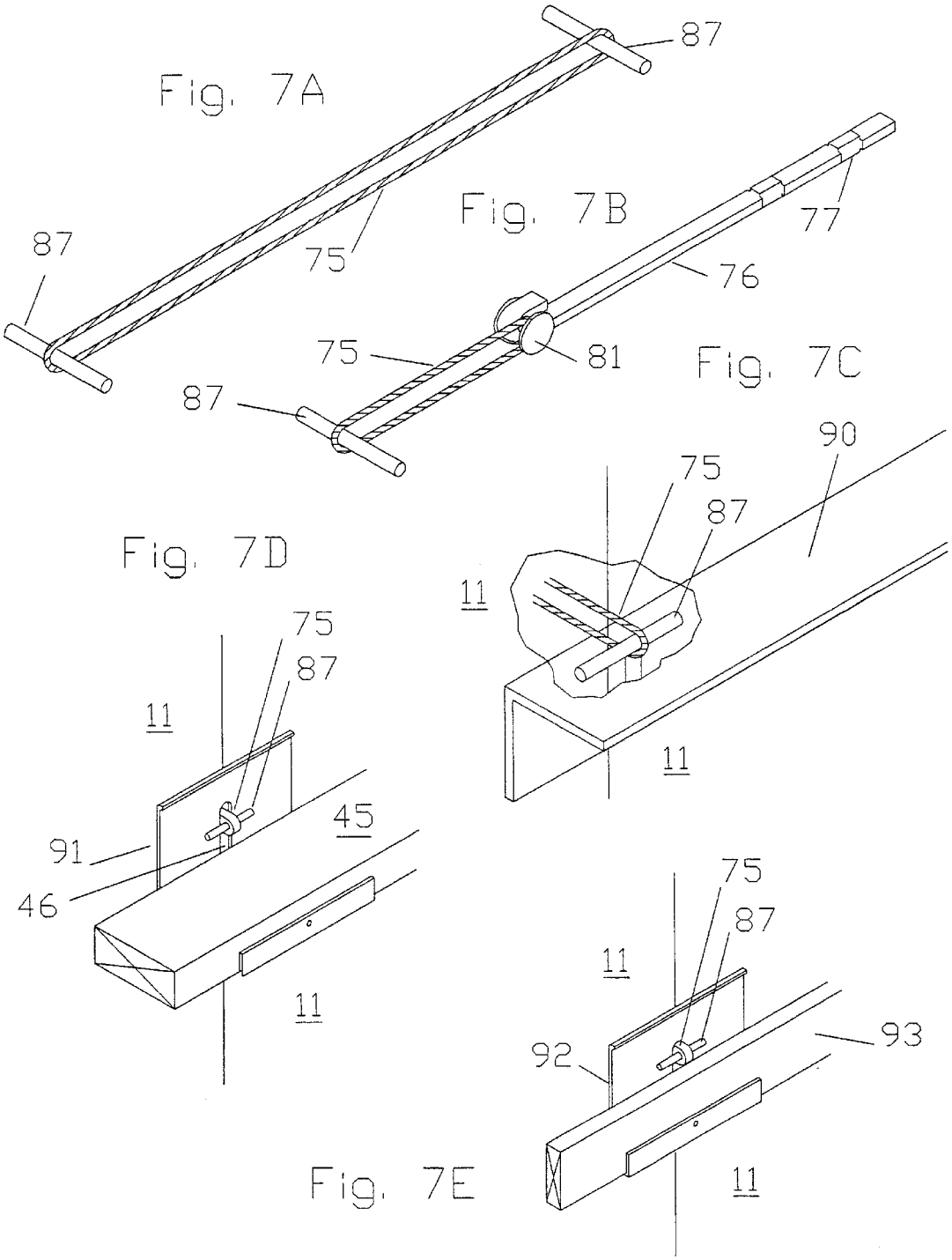
FIGS. 7A and 7B show two further ties useable in embodiments of the invention.
FIGS. 7C, 7D and 7E show the tie of FIG. 7A in use with various brackets according to the invention. All are perspective drawings.

Two further forms of tie are shown in FIGS. 7A and 7B.

In FIG. 7A, the tie is assembled on-site, from an endless cable 75 and two pins 87 such as are used in the embodiment of FIGS. 6A and 6B. The endless cable 75 forms a loop of sufficient length to permit insertion of a pin 87 outside a hooking member 2, with the cable then extending through a slot 7 of the hooking member, through the plywood, through the cavity to be filled with concrete, through the thickness of the foam panels 11 and protruding far enough outside the foam panels to permit placing of a bracket or retaining member and insertion of another pin 87 to hold the retaining member or bracket in place.

In FIG. 7B, the tie is assembled on-site, and is made from a member 76, a cable 75 and a pin 81. The assembled length of the member 76 and the cable 75 together are chosen so that, when the narrowed portion 77 is locked into a slot 7 of a hooking member 2, cable 75 protrudes outside foam panels 11 just far enough to permit attachment of a retaining member or bracket and insertion of a pin 87.

The use of several brackets with the tie of FIG. 7A or 7B (both of which are alike at the end at which the bracket attaches) is shown in FIGS. 7C to 7E. The brackets function as tie retaining means, so that the tie will not pull through the foam. In FIG. 7C (which is a partial cutaway view), the tie is attached to an angle iron 90 which is similar to the one shown in FIG. 4D, but without upturned lip 42. In FIG. 7D, it is shown attached to a bracket 91, which is similar to bracket 40 of FIG. 4A, but with a slot 46 instead of a keyhole 44. A two-by-four 45 has been inserted into the bracket to serve as a waler. In FIG. 7 E it is shown inserted into a bracket 92, which is similar to bracket 91 of FIG. 7, but which is sized to hold a one by three board (nominal size 1"33 3") 93 for use as a substrate into which to screw wallboard screws. The bracket is sized so that the board has its face, rather than its edge, parallel to panels 11, so that there will be more area exposed to which wallboard can be attached. Bracket 92 is intended to be put in place over cable 75 only after the concrete wall has hardened, so it can be of a material which is not strong enough to resist the outward force of wet concrete. Thus, bracket 92 can be of lightweight metal or plastic or the like. The brackets and retaining member illustrated in FIGS. 4A through 4D can also be used.

FIG. 8 shows an embodiment where the tie is a metal tie 300, which is generally similar to the prior art metal tie 9 illustrated in FIG. 1, but sized differently. According to the invention, it is used with cooperating pieces at its end which engage the foam panels, to adapt it to the foam panels. The cooperating pieces will be described in detail below. The end of tie 300 which is intended to engage the conventional plywood forming system is equipped with narrowed portions 301A and 301B, which correspond to narrowed portions 9A and 9B of the Prior Art system (FIG. 1).

Tie 300 can if desired have one or more bends 302 to aid bonding to the concrete which is poured into the cavity between forms when the system is in use.

At the end of tie 300 remote from narrowed portions 301A and 301B, there are two other narrowed portions 303A and 303B.

The overall length of the tie, and the locations of the narrowed portions, are chosen to conform with the thickness of the other elements of the system. The distance shown as "w" corresponds to the thickness of the wall to be poured, less the distance "y" (discussed below). Distance "w" extends just beyond (for example ¼ inch) the narrowed portion 301B in the direction of narrowed portion 301A, so that the tie can be broken off just below the surface of the concrete wall after the concrete has hardened. Distance "x" corresponds to the thickness of the plywood, so that the conventional hooking member 2 (FIG. 1) can engage the tie and permit the tie to break at 301B at a location just within the concrete. Distance "y" corresponds to the width of narrowed portion 303A. Distance "z" corresponds to the thickness of the foam panel 11 with which the tie is to be used, and terminates at the place where narrowed portion 303B starts.

The tie 300 is used in conjunction with two plastic pieces 305 and 350, and with panels 11 which have pre-cut slots 315. As is shown in FIG. 8A, the slots have a horizontal portion 316 which terminates in an upwardly extending vertical portion 317. Slots 315 are cut so that their horizontal portions 316 are at the same height above the bottom of the foam panels 11 as the places where ties 9 are secured in the prior art system with which the invention is to be used.

Figure 8B:
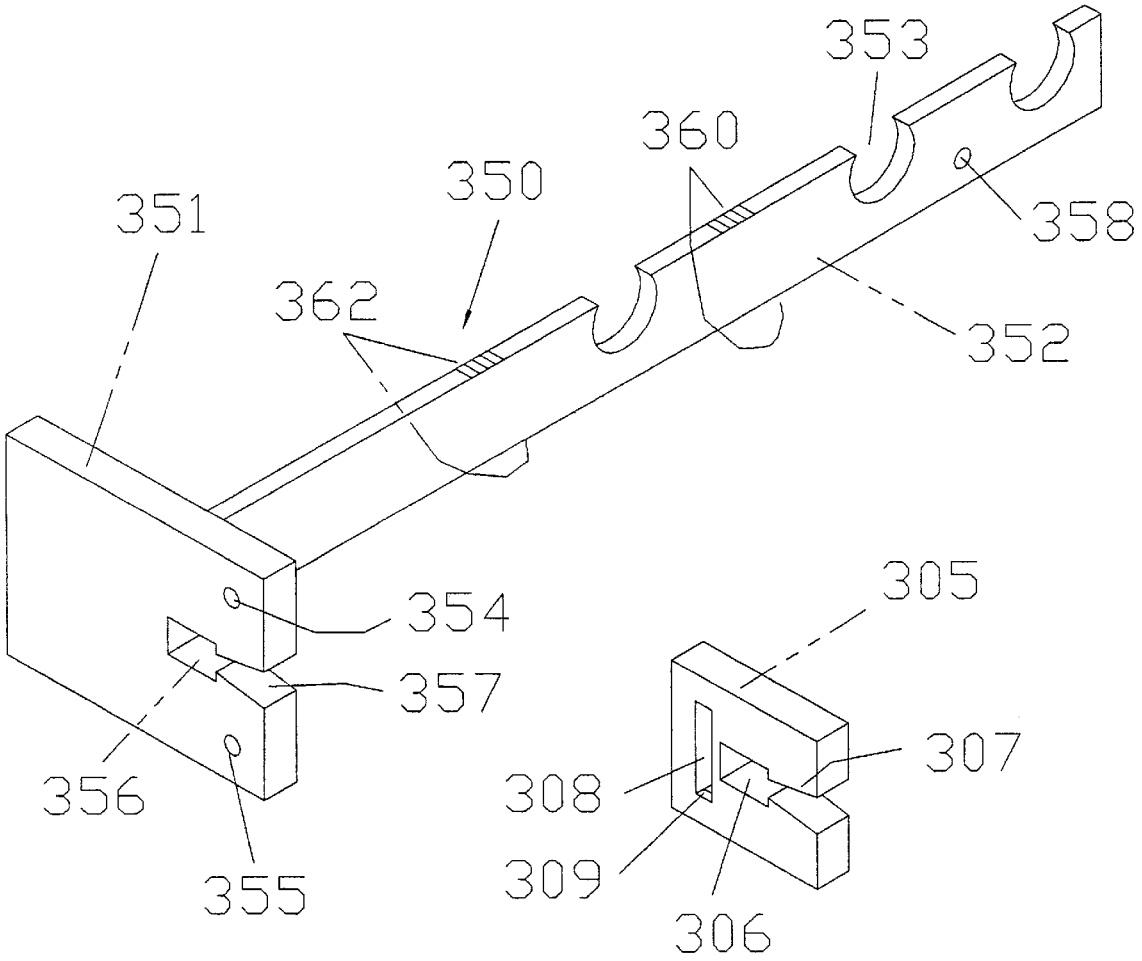

Plastic pieces 305 and 350 are shown is detail in FIG. 8B. Piece 305 has a slot 306 which is sized so that it fits over narrowed portion 303A of tie 300. Preferably, the slot has a tapered neck portion 307 which deflects to open the slot when piece 305 is pushed onto narrowed portion 303A, and which impedes detachment once the piece is fully in place on portion 303A. Conveniently, piece 305 is made of a plastic material which is slightly resilient, to permit this deflection. Piece 305 has a function similar to that of projection 25 in the embodiment of FIG. 5, in that it prevents the panel 11 from falling into the cavity where concrete will be poured.

Piece 305 also has a vertical slot 308, which may be either separate from, or joined to, slot 306. A separate slot is preferred, for strength and to prevent too much deformation of neck portion 307, because undue deformation could permit escape of narrowed portion 303A. The bottom and top of slot 308 are roughened, preferably in the form of ratchet detents, as at 309 (FIG. 8B).

Piece 350 functions as a tie retaining means, and has an end portion 351 and a tongue portion 352 perpendicular to the end portion. End portion 351 has a slot 356 and an neck portion 357 which correspond to slot 306 and neck portion 307 respectively, and also preferably has two holes 354 and 355, for a purpose to be described. Tongue portion 352 preferably has scallops 353 cut out along its length to which the concrete can bond while hardening, and has ratchet detents on its top and bottom at 360 and 362. These ratchet detents are complementary to those at 309 on stop piece 305, and the complementary detents are so oriented so that piece 305 passes easily along tongue 352 when it is being pushed onto the tongue, but so removal of piece 350 past detents 360 or 362 is difficult.

The assembly of piece 305 and piece 350 to the foam panel 11 is shown in FIG. 8A. Tongue portion 352 is inserted into slot 315 of panel 11. This may be done by merely inserting the tongue portion into the slot. Alternately, it is possible to lay piece 350 on its side (so that the tongue 352 is horizontal), and then insert the tongue sideways into slot 316. Slot 316 is wide enough relative to the thickness of the tongue so that, when the tongue reaches the end of the slot 316, it can be rotated by holding and turning end portion 351 to snap into position in slot 315. With either method of installation, end piece 351 is then pushed until it rests against foam panel 11.

Stop piece 305 is then pushed onto tongue portion 352 and is pushed along tongue portion 352 until it butts against the panel 11, so that panel 11 is held between end portion 351 and stop piece 305. Detents 360 are spaced from end portion 351 a suitable distance having regard to the thickness of foam panel 11 so that stop piece 305 is retained in position by the interaction of detents 360 and detents 309 when it is in position against panel 11.

When pieces 350 and 305 are in position against panel 11, tie 300 is inserted into slots 356, 316 and 306, so that narrowed portion 303B goes into slot 356 and narrowed portion 303A goes into slot 306. The two narrowed portions are locked in their respective slots by butting against neck portions 357 and 307 respectively.

Figure 8C:
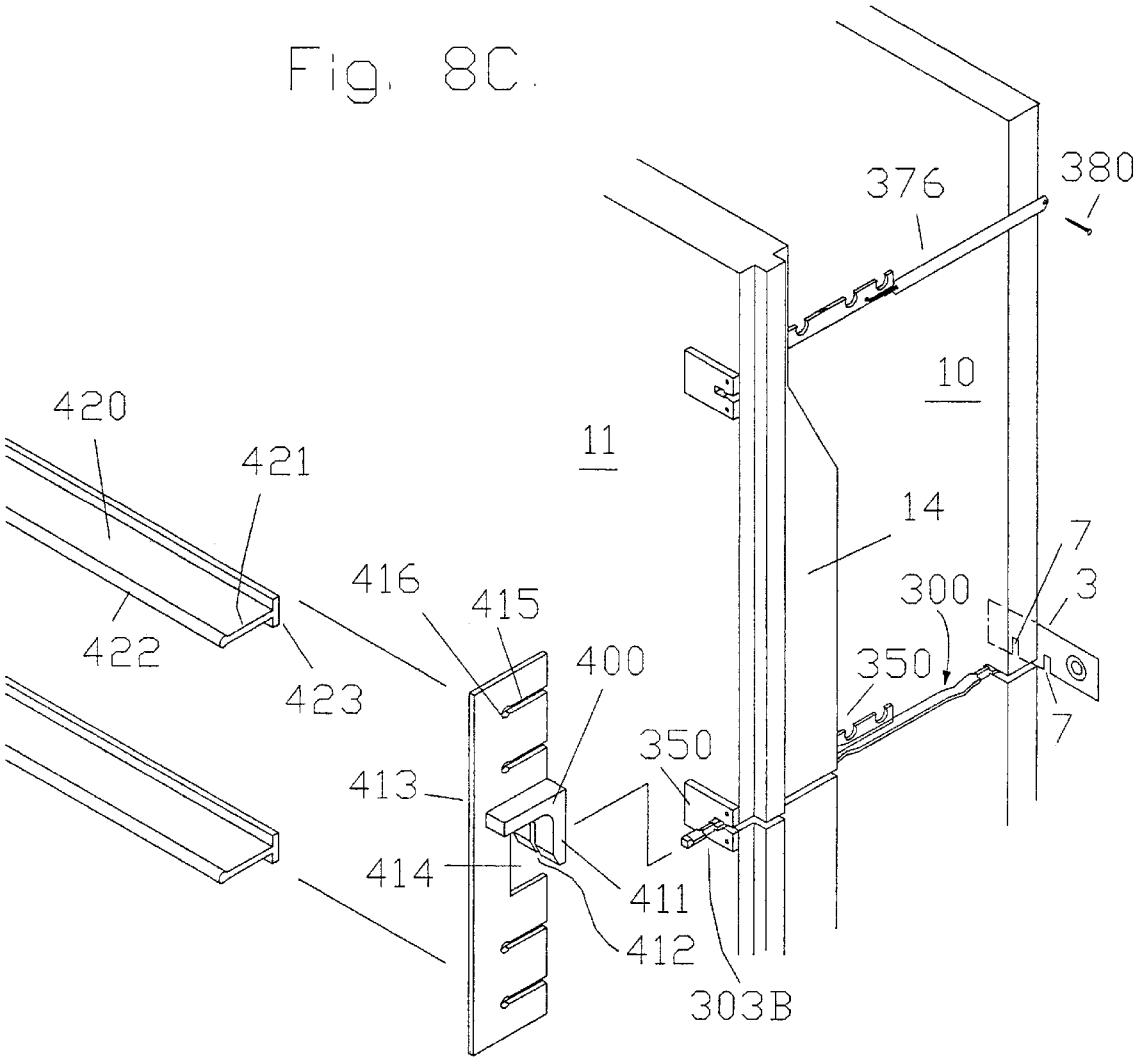

As shown in FIG. 8C, the other end of tie 11 is fitted into a conventional slot 7 in a hooking member 3 of a conventional plywood panel 10. For clarity, FIG. 8C does not show the plywood panel which would abut the end of panel 10 to carry on the form, nor the foam panel which would abut the end of foam panel 11 and provide a groove to receive tongue 14 of panel 11.

Narrowed portion 303B functions to retain a bracket or plate. The plates and brackets illustrated in the various subfigures of FIG. 4 are useable, if the slots 44 or 46 are replaced by a slot sized to fit over narrowed portion 303B. However, it is particularly preferred to use a different bracket, illustrated in FIG. 8C at 400. This bracket is suitably made of iron, and has two downward-extending fingers 411, defining between them an upwardly extending slot 412 to engage narrowed portion 303B. Preferably parallel to and in the same plane as the slot 412 is a bar 413, which is welded or otherwise attached to the bracket. It has a cutaway portion 414, to permit the slot to fit over narrowed portion 303B of tie 300. Bar 413 has a series of parallel slots 415, preferably arranged to be horizontal when in use. In the embodiment shown, the slots have parallel walls and enlarged inner ends 416.

A metal waler 420 is provided for use with brackets 400. It has a profile with a portion 421 having two parallel sides to correspond with the parallel-sided portion of slots 414, and another portion 422 corresponding to the enlarged portion 416 of slots 414. The profile also has a base 423 to bear against the foam panels 11. Many different profiles will be obvious to one skilled in the art for waler 420 and slots 414, so long as the waler profile and slots 314 are mating and the waler bears against panels 11. The walers are fed into the slots end first during assembly.

Figure 8D:
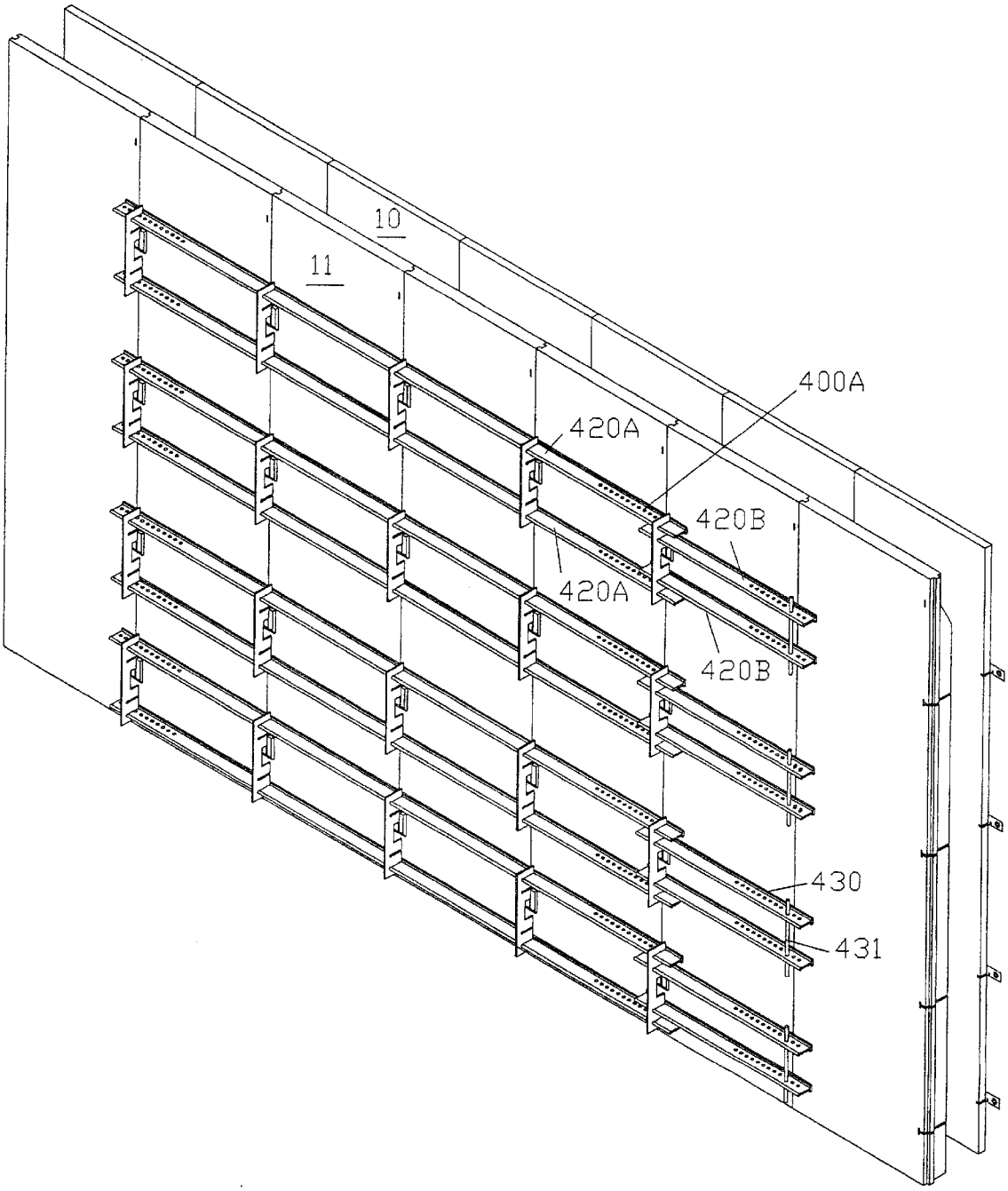

FIG. 8D shows an assembled system, ready for concrete to be poured. It will be noted that the walers 420 preferably extend across several panels 11. Walers in different slots 414 of the same bracket can extend in different directions, where overlap is desired. Thus the bracket numbered 400A has two walers 420A extending to the left and two other walers 420B extending to the right when viewed from the perspective of the figure. If desired, the walers can also be provided with holes, as at 430. These permit the attachment of vertical rods 431, which can be retained in place by a thickened portion or a clip near their top(not shown).

This embodiment provides a high degree of reinforcement for the panels 11, and the walers are easily removable for reuse either by sliding them out of slots 415. Brackets 400 can then be lifted off and the tie broken at 303B so as not to leave a protruding piece. Alternately the tie can be broken at 303A, by the use of a known tie-breaking tool such as is conventionally used for breaking ties associated with plywood forms. When the tie is broken at 303A, the tie the does not then provide a heat-transfer channel through the full thickness of the insulating foam panels 11. A small hole is left in the panel, but this can be caulked if desired.

Typically, existing plywood form systems do not have hooking members 3 very close to the top of plywood panels 10. However, since foam is not as strong as plywood, it is advisable to have the foam panel attached to the plywood near the top.

In the embodiment of FIGS. 8A–D, attachment of the top of the foam panel to the top of the plywood panel is accomplished as shown in FIGS. 8A and 8C, by providing a slot 375 which is preformed in the foam panel 11 at a convenient distance (preferably about 2–4 inches) from the top. This slot corresponds to portion 317 of slot 315. A piece 350 is pushed through slot 375 until its portion 351 abuts against the foam. A stop piece 305 is pushed onto portion 352 to bear against the foam 11. As the foam panel 11 is preferably narrowed near the top (to provide for the pouring of a concrete shelf, as discussed with respect to reference numeral 12 in FIG. 3), the stop piece can travel farther along portion 352 than it could if the portion 352 were farther down. Thus, roughened portions 362 are located on portion 352 at a suitable distance from portion 351 so that they can be engaged by roughened portions 309 of stop piece 305 when the stop piece is pushed against the foam panel.

A flat metal strip 376, with holes 377, 378 at its two ends, forms the top tie. For assembly, a wire clip 379 is retained at one end in hole 377 and at the other end in hole 358 of piece 350. Alternately, hole 377 can be aligned with hole 358 of piece 350, and the two be secured together with a cotter pin or like device (not shown). The other end of metal strip 376 is slipped through the crack between the abutting ends of two plywood panels 10 (only one of which is shown in FIG. 8C), and is retained from pulling out by a transverse member such as nail 380 being put through hole 378. The length of metal strip 376 is chosen so that, when it is attached to member 350, it will protrude just far enough outside the plywood panel 10 so that transverse member or nail 380 can be inserted. Even though wire clip 379 is not very resistant to deformation, this arrangement is satisfactory because there is little force at the top of the wall tending to pull apart the plywood and the foam panels.

Figure 9:
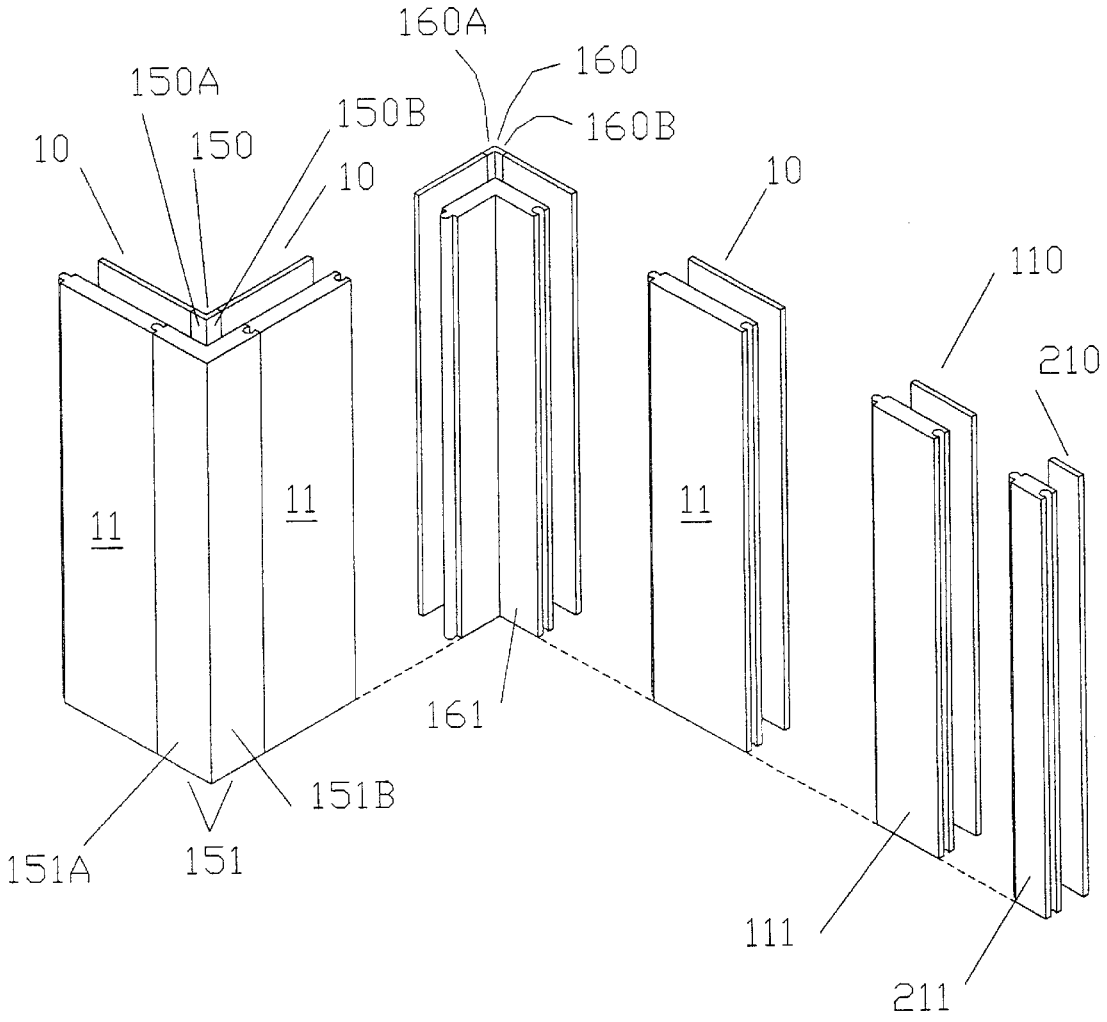
FIG. 9 shows various shapes of plastic foamed panel, designed for use with the invention, as well as existing prior art plywood panels.

FIG. 9 shows various shapes of foam panels which can be provided as part of the system of the invention. Each is complementary to a plywood panel of a conventional system, so that when plywood panels are assembled to make the form for one side of a concrete wall to be poured, and panels according to the invention are assembled to make the form for the other side of that wall, then the joins between panels are directly opposite one another. Thus, in FIG. 9, there is shown complementary plywood and foam panels. The panels are oriented as they would be to make a form for a wall having two corners along its length. Some are shown assembled, but, for clarity, no ties or brackets or retaining members are shown.

As will be evident to one skilled in the art, adverse conditions, including high winds, are found at many construction sites, and also the footing 101 in which panels 11 rest their bottom ends is not always level. Therefore, it is sometimes difficult to hold the panel 11 being assembled to a form while tongue 14 of the panel forming part of the form is inserted into groove 15 of the newly added panel. To retain the panel in place, one leg of a large metal or plastic staple can be inserted through a hole 354 or 355 of a piece 350. The other end can be driven into the foam of a panel 11 being added to the form, to retain it temporarily. Such a staple is shown at 390. It has two legs 391 and 392. Leg 391 is pushed into hole 354 of one of the pieces 350. The other leg is merely thrust into the foam of panel 11, making a hole. Alternately, the panel can have attached to it, adjacent its edge with groove 15, a hook member (not shown) similar to hook member 3, and this can hook over a nail or stud inserted in a hole 354 or 355. These provide a temporary attachment to hold the panel in place until ties 300 are put in place to attach it rigidly to a plywood panel 10.

FIG. 9 shows plywood panels 10 and foam panels 11, which are the standard width and height for the plywood form system with which the invention is to be used. For example, these can be 24" in width and 8 feet in height. Plywood panel 110 and complementary foam panel 111, although they are the same height as panels 10 and 11, are only ¾ as wide. Plywood panel 210 and complementary foam panel 211 are also the same height as panels 10 and 11, but are only ⅙ as wide. Panels 110. 111. 210 and 211 are used when the length of the wall to be made is not an even multiple of the width of panels 10 and 11. Complementary corner panels 150 of plywood and 151 of foam are used when there is to be a corner where the plywood side of the form turns inward and complementary corner panels 160 of plywood and 161 of foam are used where there is a corner where the plywood side of the form turns outward. Panel 150 and 151 each is made up of two panels joined at right angles. The plywood panels are 150A and 150B, and the foam panels (which may be moulded as a single unit if desired) are 151A and 151B. Similarly, panel 160 is made of panels 160A arid 160B joined at right angles and panel 161 is made of subpanels 161A and 161 B (which may be moulded as a single unit if desired) joined at right angles. Panel 150A and 151A are not of the same width: instead, they differ in width by the thickness of the concrete wall to be poured, with the panel on the outer side of the corner (in this case 151A) being longer. There is a similar difference in width between 151A and 151B, between 160A and 161A and between 160B and 161B, so that the ends of the panels, after the thickness of the concrete wall is taken into account, will be opposite one another. Half height or quarter height panels (not shown) can also be provided to permit the pouring of a wall around a window frame. In each case, however, there are complementary foam and plywood panels assembled so that the longitudinal edges of each foam panel are directly opposite the longitudinal edges of a plywood panel, thereby permitting ties according to the invention to join them at their edges.

It will be understood that the foregoing embodiments are only illustrative of the invention, and not limitative, and that further embodiments will be evident to one skilled in the art.

What is claimed is:

1. A form for pouring concrete which comprises;

(a) two opposed walls with a cavity between them to receive the concrete, one wall being made of a plurality of plywood or metal panels having vertical edge-to-edge joins between them and the other wall being made of a plurality of foam panels having vertical edge-to-edge joins between them;

(b) said foam panels and said plywood or metal panels being so assembled that the vertical joins between the plywood or metal panels and the vertical joins between the foam panels are opposite one another;

(c) a plurality of ties, each extending between the plywood or metal panels and the foam panels at a place where each has a vertical join;

(d) means attaching each tie firmly to at least one plywood or metal panel; and (e) tie retaining means for retaining the tie against at least one foam panel adjacent its said vertical join with a second foam panel so that the outward pressure from wet concrete within the cavity is transferred by said tie retaining means to the tie and by the tie to the plywood or metal panel to which the tie is attached, (f) said foam panels being supplied with slots adjacent one vertical edge, (g) said tie retaining means being positioned in said slots to retain the ties in a rigid relationship with the foam panel, (h) said tie retaining means having a blade portion which extends through a said slot and into the cavity, and a head which lies against the surface of the foam panel remote from the cavity, and a first tie retaining clip.

2. A form as claimed in claim 1, additionally comprising a stop piece adapted to fit onto said blade portion and abut against the side of the foam panel within the cavity.

3. A form as claimed in claim 2, in which the stop piece has a second tie retaining clip.

4. A form as claimed in claim 1, additionally comprising a waler-retaining bracket adapted to be retained by a portion of the tie.

* * * * *